US009532661B2

(12) United States Patent
Jafa

(10) Patent No.: US 9,532,661 B2
(45) Date of Patent: Jan. 3, 2017

(54) MODULAR REFRIGERATED MERCHANDISE DISPLAY SYSTEM

(71) Applicant: PepsiCo, Inc., Purchase, NY (US)

(72) Inventor: Emad Jafa, Brewster, NY (US)

(73) Assignee: PEPSICO, INC., Purchase, NY (US)

( * ) Notice: Subject to any disclaimer, the term of this patent is extended or adjusted under 35 U.S.C. 154(b) by 72 days.

(21) Appl. No.: 13/660,561

(22) Filed: Oct. 25, 2012

(65) Prior Publication Data

US 2013/0047646 A1 Feb. 28, 2013

Related U.S. Application Data

(63) Continuation-in-part of application No. 13/292,166, filed on Nov. 9, 2011, now abandoned, which is a (Continued)

(51) Int. Cl.
*A47F 3/04* (2006.01)
*F25B 49/00* (2006.01)
(Continued)

(52) U.S. Cl.
CPC ..... *A47F 3/0404* (2013.01); *F25D 23/06* (2013.01); *A47F 5/10* (2013.01); *F25D 2400/16* (2013.01)

(58) Field of Classification Search
CPC ..... F25D 23/06; F25D 23/065; F25D 23/006; F25D 23/069; F25D 2400/16; F25D 19/003; F25D 23/08; F25D 23/061; F25D 23/067; A47F 3/0404; A47F 3/0426; A47B 47/0083; A47B 47/05; A47B 47/03; H02B 1/301
(Continued)

(56) References Cited

U.S. PATENT DOCUMENTS 1,321,097 A 11/1919 Gonzalez
1,883,961 A 10/1932 Kosmerl
(Continued)

FOREIGN PATENT DOCUMENTS

EP 0 334 414 A2 9/1989
EP 0 379 460 A2 7/1990
(Continued)

OTHER PUBLICATIONS

International Search Report & Written Opinion with a mailing date of Dec. 19, 2012, for International Application No. PCT/US2012/064279 (11 pages total).
(Continued)

*Primary Examiner* — Len Tran
*Assistant Examiner* — Kirstin Oswald
(74) *Attorney, Agent, or Firm* — Sterne, Kessler, Goldstein & Fox P.L.L.C.

(57) ABSTRACT

A merchandise display system including one or more display units is described. The merchandise display system may include a base unit having a refrigeration unit that cools one or more display units. The refrigeration unit may be removable from the base unit. The one or more display units may attach to another display unit or a base unit. The display units may be stackable on top of one another. The display units may also be configured to attach to the base unit. The one or more display units may include one or more doors, which allow access to display units. The display units may include a C-shaped panel that forms the side walls and back wall of each of the display units.

16 Claims, 15 Drawing Sheets

Related U.S. Application Data continuation-in-part of application No. 13/173,351, filed on Jun. 30, 2011, now abandoned.

(51) Int. Cl.
*F25D 23/06* (2006.01)
*A47F 5/10* (2006.01)

(58) Field of Classification Search
USPC ... 62/246, 252, 251, 77, 326, 264, 298, 411, 62/448, 449, 302
See application file for complete search history.

(56) References Cited

U.S. PATENT DOCUMENTS 2,127,111 A * 8/1938 Gaenzle ..... E04B 1/76 220/592.2
2,387,465 A * 10/1945 Peltier ..... F25D 19/02 165/73
2,426,525 A * 8/1947 Rundell ..... F25D 23/082 220/592.07
2,429,294 A * 10/1947 Pollock ..... F25D 19/02 312/107
2,510,758 A * 6/1950 Rundell ..... F25B 25/005 62/286
2,554,610 A * 5/1951 Benson ..... A47F 3/0482 277/641
2,915,884 A 12/1959 Haushalter et al.
3,252,258 A * 5/1966 Blickman ..... F25D 19/00 165/53
3,392,543 A 7/1968 Miller
3,631,630 A * 1/1972 Buffington ..... F25D 23/02 49/402
3,656,248 A 4/1972 Echter
3,708,997 A * 1/1973 McLaughlin ..... F25D 19/00 62/263
3,712,078 A 1/1973 Maynard et al.
3,811,559 A * 5/1974 Carter ..... A45C 11/20 126/266
3,948,407 A * 4/1976 Puterbaugh ..... F25D 23/064 220/4.01
4,120,550 A * 10/1978 Sherburn ..... F25D 23/02 312/296
4,135,369 A 1/1979 Allgeyer et al.
4,247,011 A 1/1981 Walter
4,330,310 A * 5/1982 Tate, Jr. ..... F25D 21/04 312/407
4,417,450 A 11/1983 Morgan, Jr. et al.
4,523,439 A 6/1985 Denisot
4,592,209 A 6/1986 Casanova et al.
4,609,975 A 9/1986 Badolato et al.
4,723,418 A 2/1988 Whitmer, II
5,086,627 A 2/1992 Borgen
5,277,486 A 1/1994 Bustos
5,284,023 A * 2/1994 Silva et al. ..... F25D 19/02 312/236
5,399,005 A * 3/1995 Schafer ..... G07B 3/04 206/509
5,458,407 A 10/1995 Bustos et al.
5,475,987 A * 12/1995 McGovern ..... A47F 3/0447 62/256
5,501,516 A 3/1996 Federico
5,508,898 A 4/1996 McGovern
5,584,189 A 12/1996 Bustos
5,600,966 A 2/1997 Valence et al.
5,669,233 A 9/1997 Cook et al.
5,996,366 A * 12/1999 Renard ..... A47F 3/04 62/256
6,105,793 A 8/2000 Riga
6,128,911 A 10/2000 Mathews et al.
6,464,312 B1 * 10/2002 Tenhundfeld ..... E05C 19/161 312/296
6,539,740 B1 4/2003 Santana, Jr.
6,550,269 B2 4/2003 Rudick
6,990,828 B2 1/2006 Kim et al.
7,174,851 B2 2/2007 Bonner et al.
7,254,952 B2 8/2007 Lilke
7,334,425 B1 2/2008 Johnson
7,431,409 B2 * 10/2008 Yang ..... A47B 47/0041 312/263
7,712,852 B2 5/2010 Choi et al.
7,905,370 B2 * 3/2011 Leonetti ..... A47F 1/082 221/1
2003/0222546 A1 * 12/2003 Canedy ..... A47F 3/002 312/114
2003/0226657 A1 12/2003 Wallace
2004/0035142 A1 2/2004 Yoon et al.
2004/0226309 A1 11/2004 Broussard
2005/0126196 A1 6/2005 Grassmuck et al.
2005/0172654 A1 8/2005 Rohrer et al.
2005/0262863 A1 12/2005 Iguchi et al.
2006/0107676 A1 5/2006 Fockter
2006/0117789 A1 6/2006 Yamasaki et al.
2006/0278369 A1 12/2006 Maidment
2007/0216270 A1 * 9/2007 Betto ..... F25D 23/063 312/404
2007/0289976 A1 * 12/2007 Meyer et al. ..... 220/592.09
2008/0148765 A1 * 6/2008 Barone ..... F25D 17/06 62/407
2008/0252184 A1 10/2008 Decker et al.
2008/0277407 A1 11/2008 Leonetti
2009/0000316 A1 1/2009 Cohen et al.
2009/0120761 A1 5/2009 Bashor et al.
2009/0165488 A1 7/2009 Chen
2009/0217689 A1 * 9/2009 Chakiachvili ..... B60H 1/00364 62/239
2010/0205991 A1 8/2010 Ernst et al.
2013/0047646 A1 * 2/2013 Jafa ..... F25D 23/06 62/125
2014/0062836 A1 * 3/2014 Hyman ..... G09F 9/3026 345/1.3

FOREIGN PATENT DOCUMENTS

FR 2 701 095 A1 8/1994
FR 2 738 056 A1 2/1997
FR 2812078 A3 1/2002
FR 2 893 166 A1 5/2007
FR 2 907 202 A1 4/2008
GB 2 282 875 A 4/1995
JP 2003-130538 A 5/2003
JP 2005-42937 A 2/2005
WO WO9510964 4/1995
WO WO2008046984 4/2008

OTHER PUBLICATIONS

Machine Translation of FR 2907202 A1 in French. English machine translation Jun. 2013.
International Search Report & Written Opinion with a mailing date of Feb. 24, 2014, for International Application No. PCT/US2013/061407 (14 pages total).
International Search Report & Written Opinion mailed Sep. 24, 2012, International Application No. PCT/US2012/030230.

* cited by examiner

MODULAR REFRIGERATED MERCHANDISE DISPLAY SYSTEM

CROSS REFERENCE TO RELATED APPLICATIONS

This Application is a continuation-in-part application of U.S. application Ser. No. 13/292,166, filed Nov. 9, 2011, which is a continuation-in-part application of U.S. application Ser. No. 13/173,351, filed Jun. 30, 2011. These applications are incorporated by reference in their entirety.

FIELD OF THE INVENTION

The invention relates generally to a modular refrigerated display system for storing and dispensing merchandise.

BACKGROUND

Commercial refrigerators have had the same design and construction for many years. Commercial refrigerators are typically large heavy boxes that have failed to keep up with design trends and consumer expectations. Because of the large size, commercial refrigerators are often under-utilized and only partially filled. The walls of commercial refrigerators are generally formed from two thin steel plates with insulating polyurethane foam injected between them. This construction makes the commercial refrigerators heavy, time-consuming to build, and difficult to recycle. Additionally, many of the commercial refrigerators have negative impacts to the environment because of the type of refrigerant and compressor used.

SUMMARY OF THE INVENTION

An object of this invention described herein is to provide a light weight modular refrigerated merchandise display system that may be customized depending on the amount of space required. Another object of the invention is to provide visual access of the merchandise within the display system to a customer from one or more angles. Another object of the invention is to provide an easily accessible and replaceable refrigeration unit.

In one aspect of the invention, a merchandise display system includes one or more display units. The one or more display units may include at least one shelf and at least one door for accessing the display unit. The merchandise display system may include a base unit. The base unit may be removable from the merchandise display system. The base unit may also include a cooling system configured to cool the one or more display units and a sensor system configured to sense environmental parameters within the one or more display units. The one or more display units may be attached to the top of the base unit. In at least one embodiment, the merchandise display system includes a plurality of display units attached one on top of each other with the lowermost display unit attached to the top of a base unit.

In another aspect of the invention, a merchandise display system includes one or more display units. In at least one embodiment of the invention, the merchandise display system includes a plurality of display units positioned back to back. In this embodiment, each of the display units includes a plurality of top doors and a plurality of bottom doors. Each display unit may further include a plurality of shelves. The plurality of shelves may be movable within the merchandise display system. Each of the display units may also include a refrigeration unit, which may be removable from the display unit.

In another aspect of the invention, components of a merchandise display system are shipped flat to a merchandising location and assembled at the merchandising location. In at least one embodiment of the invention, one or more components of a merchandise display system, such as doors, side walls, top walls, bottom walls, front walls, shelves, and back walls are stacked on top of each other and adjacent each other and are shipped to a merchandising location in a generally flat configuration. In this embodiment, the components are assembled at a merchandising location to form a modular refrigerated merchandise display system that includes a base unit and one or more display units. The base unit may include a cooling system that is removable from the base unit. In an alternative embodiment, the base unit is pre-assembled and shipped to the merchandising location separately from the components for the one or more display units.

DETAILED DESCRIPTION OF THE INVENTION

Figure 1:
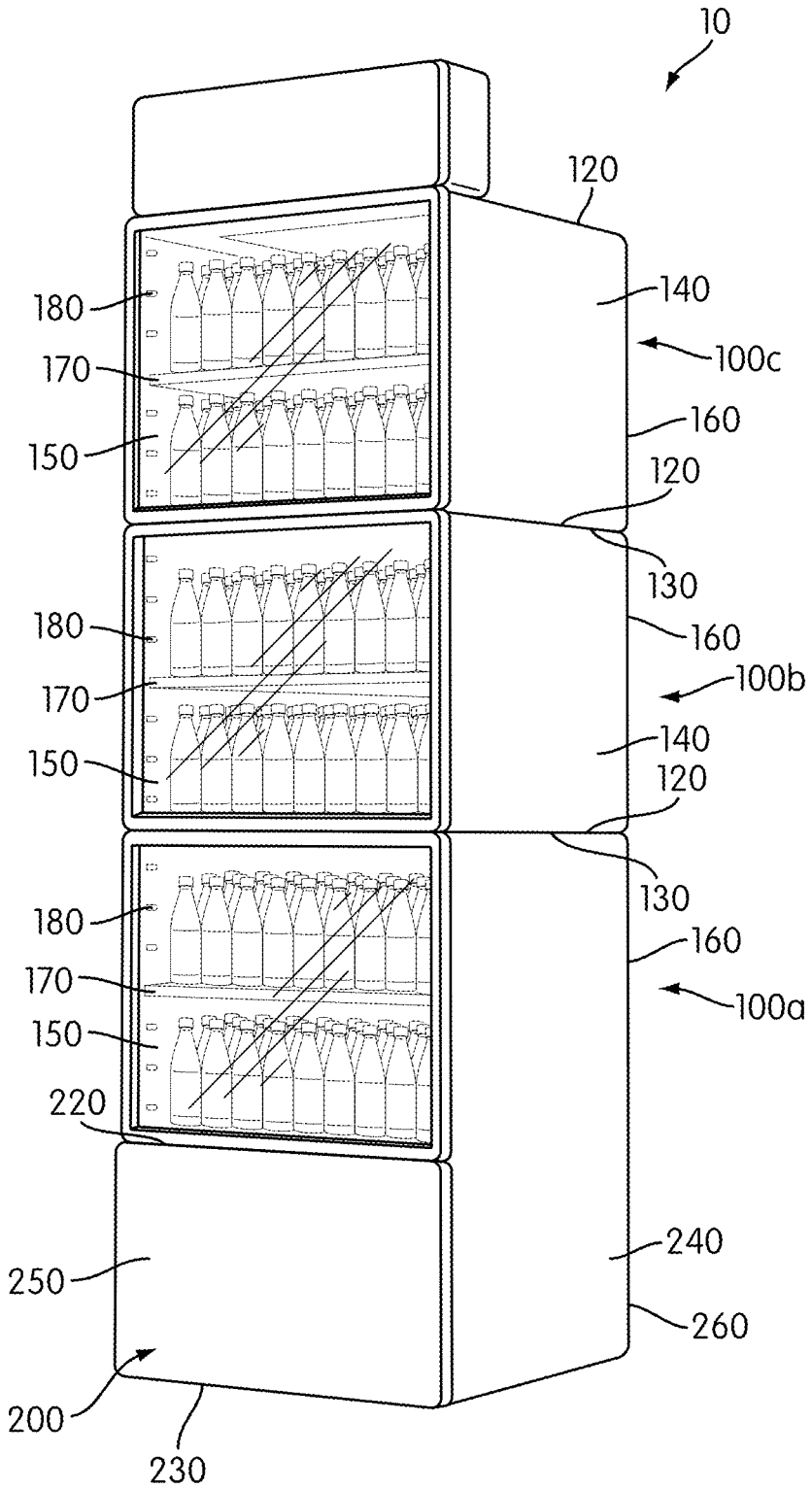
FIG. 1 is a perspective view of a merchandise display system in accordance with at least one embodiment of the present invention.
Figure 3:
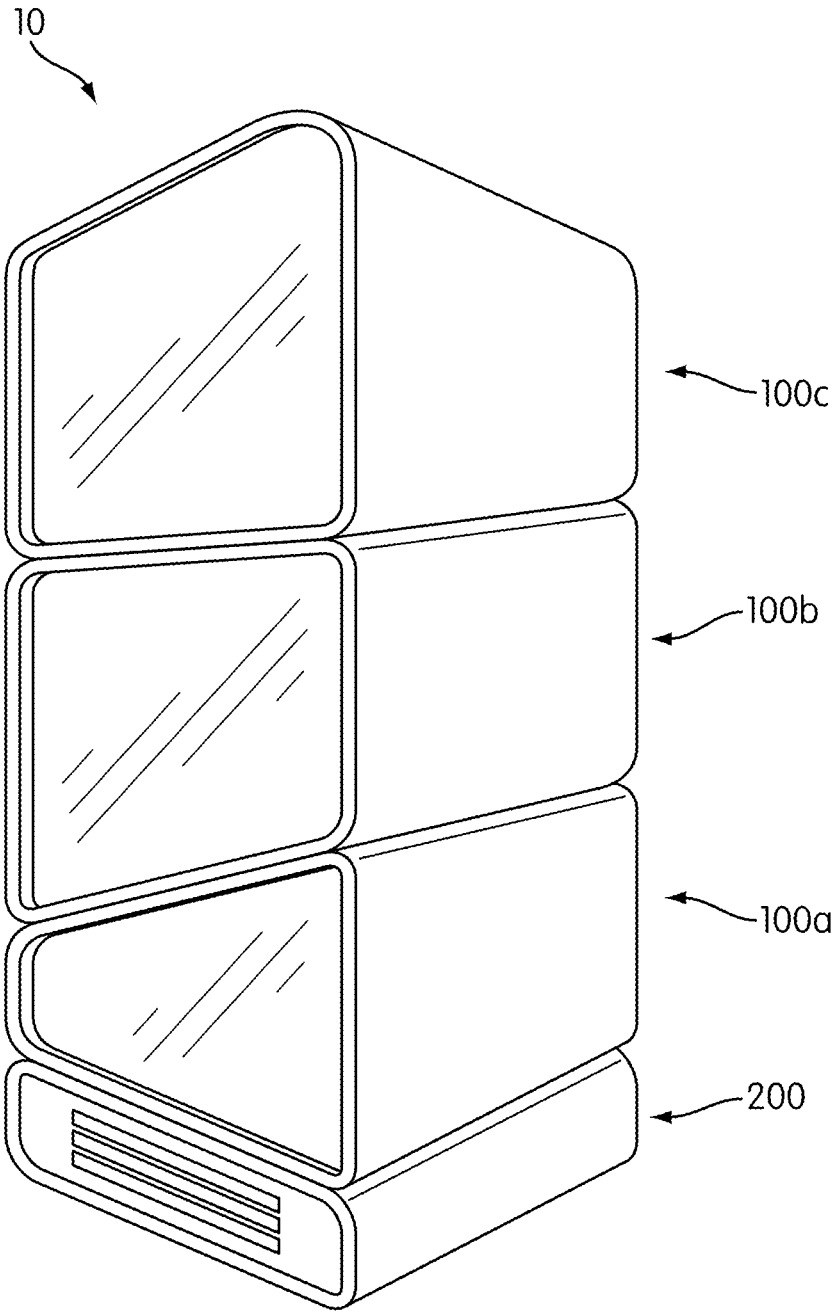
FIG. 3 is an alternative embodiment of the merchandise display system of FIG. 1.

Referring to FIGS. 1 and 3, the merchandise display system according to one embodiment of the present invention is indicated generally at 10. The merchandise display system 10 may be of a modular construction and include a plurality of display units 100 and a base unit 200. The display units 100 and base unit 200 may be made of any suitable material, such as plastic or metal. In one embodiment, the display units 100 are hollow structures filled with a foam-based insulation material, which may reduce the weight of the merchandise display system 10. In one embodiment, the base unit 200 is also a hollow structure filled with a foam-based insulation material, which may reduce the weight of the merchandise display system 10.

The display units 100 and base unit 200 may be any suitable size or shape. In one example, as illustrated in FIG. 1, the display units 100 and base unit 200 are generally cube shaped. Alternatively, as illustrated in FIG. 3, the display units 100 and base unit 200 may be generally trapezoidal. Any suitable shape is contemplated within the scope of this invention, such as a rectangle, circular, or oval shape. The display units 100 and base unit may be the same shape or different shapes.

Referring back to FIG. 1, each of the plurality of display units 100 includes a top wall 120, two side walls 140, a bottom wall 130, a door 150, and a back wall 160. The door 150 may be made of any suitable material, such as glass or plastic. In at least one embodiment, the door 150 is transparent to allow visual access to the product stored and displayed within the display unit 100. The door 150 may open in any suitable manner. For example, in at least one embodiment, one side of the door 150 is hingedly attached to the display unit 100 and the door 150 swings open to allow access to the display unit 100. In at least one embodiment, the door 150 includes a handle for opening the door 150.

Each of the display units 100 may include one or more shelves 170. The shelves 170 may be movable within the display units 100 to accommodate different types or heights of products. Any number of shelves 170 is contemplated within the scope of this invention. The number of shelves 170 may be dependent on the size of the merchandise displayed in the display unit 100, may be dependent on the size of the display unit 100, or a combination of both.

Each display unit 100 may have a lighting system controlled by an electrical module in the base unit 200. In at least one embodiment, the lighting system includes eight light emitting diodes ("LEDs") 180 installed on the inner surface of each of side walls 140 of the display units 100, as illustrated in FIG. 1. The lighting system may also include exterior lights to attract customers to the merchandise display system 10.

Figure 2A:
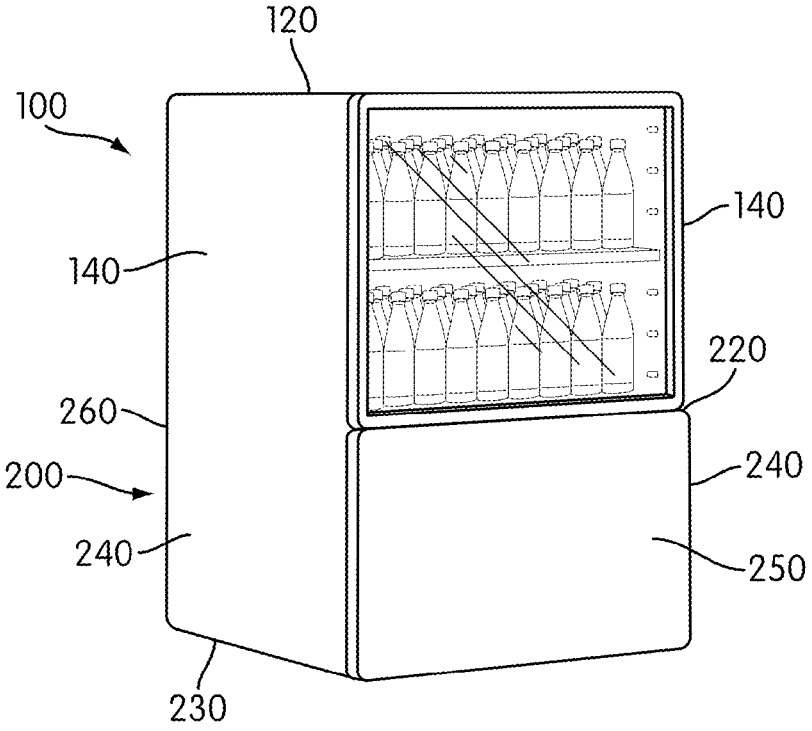
FIG. 2*a* is a perspective view of a base unit and a display unit in accordance with at least one embodiment of the present invention.
Figure 2B:
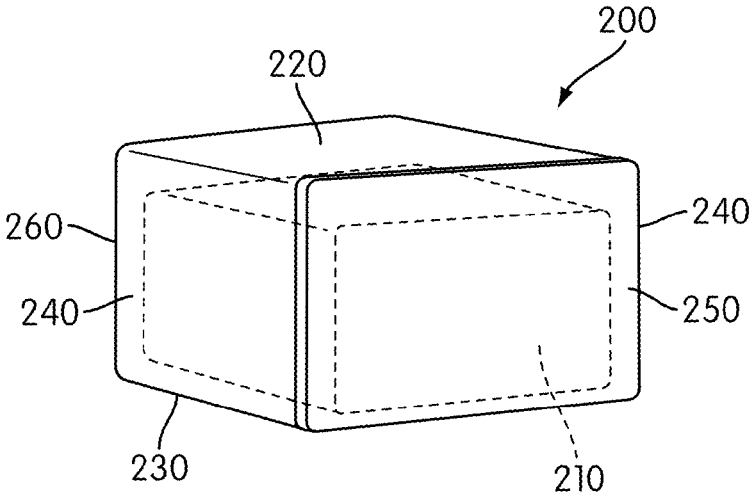
FIG. 2*b* is a perspective view of a base unit.

Referring to FIGS. 2*a* and 2*b*, the base unit 200 has a top wall 220, a bottom wall 230, two side walls 240, a back wall 260 and a front wall 250. In at least one embodiment, the front wall 250 may be a door. The door may open in any suitable manner. For example, the door may be hinged on one side and swing open to allow access into the base unit 200. In another embodiment, the front wall 250 may be a front portion of a drawer housed within the base unit 200. In this embodiment, the drawer may slide out of the base unit 200. The front wall 250 may be a solid construction or may contain apertures to allow air to flow into and out of the base unit 200.

The base unit 200 may include a cooling system and sensor system. The sensor system may be configured to sense the environment within the display units 100. For example, the sensor system may be configured to detect the temperature or humidity in the interior of the display units 100. In at least one embodiment, the sensor system is in communication with the cooling system in the base unit 200.

As illustrated in FIG. 2*b*, the cooling system may include a refrigeration unit 210 that is configured to cool the interior of the plurality of display units 100. The refrigeration unit 210 may cool any number of display units 100. For example, the refrigeration unit 210 may cool one display unit 100 or four display units 100. In at least one embodiment, the refrigeration unit 210 is configured to cool three display units 100. In at least one embodiment, the refrigeration unit 210 is removable from the base unit 200. The refrigeration unit 210 may cool each display unit 100 is any suitable way. In one embodiment, a hose is connected from the refrigeration unit 210 to each of the display units 100. In this embodiment, the hose transports air from the base module and sends it to the display units 100.

The refrigeration unit 210 may include typical refrigeration components such as a compressor, a condenser, an evaporator, a fan, etc. The refrigeration unit 210 may use any suitable type of refrigerant to cool the merchandise display system 10. For example, R134A (tetraflouroethane), CO2 (carbon dioxide), or hydrocarbons may be used. The refrigeration components may be placed within the same enclosure in the refrigeration unit 210 and separated as necessary by insulating material. Alternatively, some of the refrigeration components may be placed in separate enclosures within the refrigeration unit 210.

The merchandise display system 10 may utilize any applicable insulation. In one embodiment, the merchandise display system 10 incorporates Aerogel insulation material. Specifically, the merchandise display system may incorporate Spaceloft insulation. The use of Spaceloft insulation may decrease the required thickness of the walls of the display system 10. Insulation may also be used in the refrigeration unit 210 to separate the condenser and evaporator within the same refrigeration unit 210.

In one embodiment, the refrigeration unit 210 may be a hybrid convection-conduction refrigeration system. In this embodiment, the refrigeration unit 210 may include a traditional vapor-compression system, which forces cool air from the refrigeration unit 100 through the display units 100 in the merchandise system 10. The merchandise displayed in the merchandise display system 10 may be cooled through a conduction process where thermal energy is passed from the shelves 170 to the merchandise to cool the merchandise. In this embodiment, heat generated during the cooling process is transferred out of the refrigeration unit 210 and display units 100. In one embodiment, the refrigeration unit 210 may include an ice pack wall or a cold wall, which includes a mix of glycol and water. In this embodiment, the cold wall may maintain the temperature of the refrigeration unit 210 for a period of time when the refrigeration unit 210 is turned off.

Each display unit 100 may be configured to attach to the base unit 200 or another display unit 100. In this embodiment, each display unit 100 is configured to engage with or attach to the top wall 220 of a base unit 200. Each display unit 100 may also be configured to engage with a top wall 120 of another display unit 100. In at least one embodiment, as depicted in FIGS. 1 and 3, the merchandise display system 10 includes a single base unit 200 and three display units 100*a-c*. In this embodiment, the base unit 200 is located at the bottom. A first display unit 100*a* is attached to the top wall 220 of the base unit 200. A second display unit 100*b* is attached to the top wall 120 of the first display unit 100*a* and a third display unit 100*c* is attached to the top wall 120 of the second display unit 100*b*. In one embodiment, as illustrated in FIG. 2*a*, the base unit 200 may be of unitary construction with one of the display units 100.

The display units 100 may be attached to the base unit 200 and other display units 100 in any suitable manner. In at least one embodiment, the display units 100 and the base unit 200 are attached together through the use of corresponding rails. In this embodiment, the base unit 200 may include one or more rails on the top wall 220 of the base unit 200, which engages with one or more corresponding rails on the bottom wall 130 of a base unit 100. The display units 100 may attach to each other in a similar manner. For example, each of the display units 100 may include one or more rails on each of the top walls 120, which may attach to one or more corresponding rails on the bottom walls 130 of another display unit 100. In this embodiment, the rails keep the display units 100 and base unit 200 aligned to give the appearance of a single refrigerator. However, display units 100 may be added or removed depending on the amount of space required.

The merchandise display system 10 may include logos or signs to further promote the brand or type of merchandise within the merchandise display system 10. The logos and signs may be place on any suitable surface of the merchandise display system 10. For example, a sign may be placed on the top wall 120 of the top display unit 100 or logos may be attached to the doors 150 or side walls 140 of the display units 100.

Figure 4:
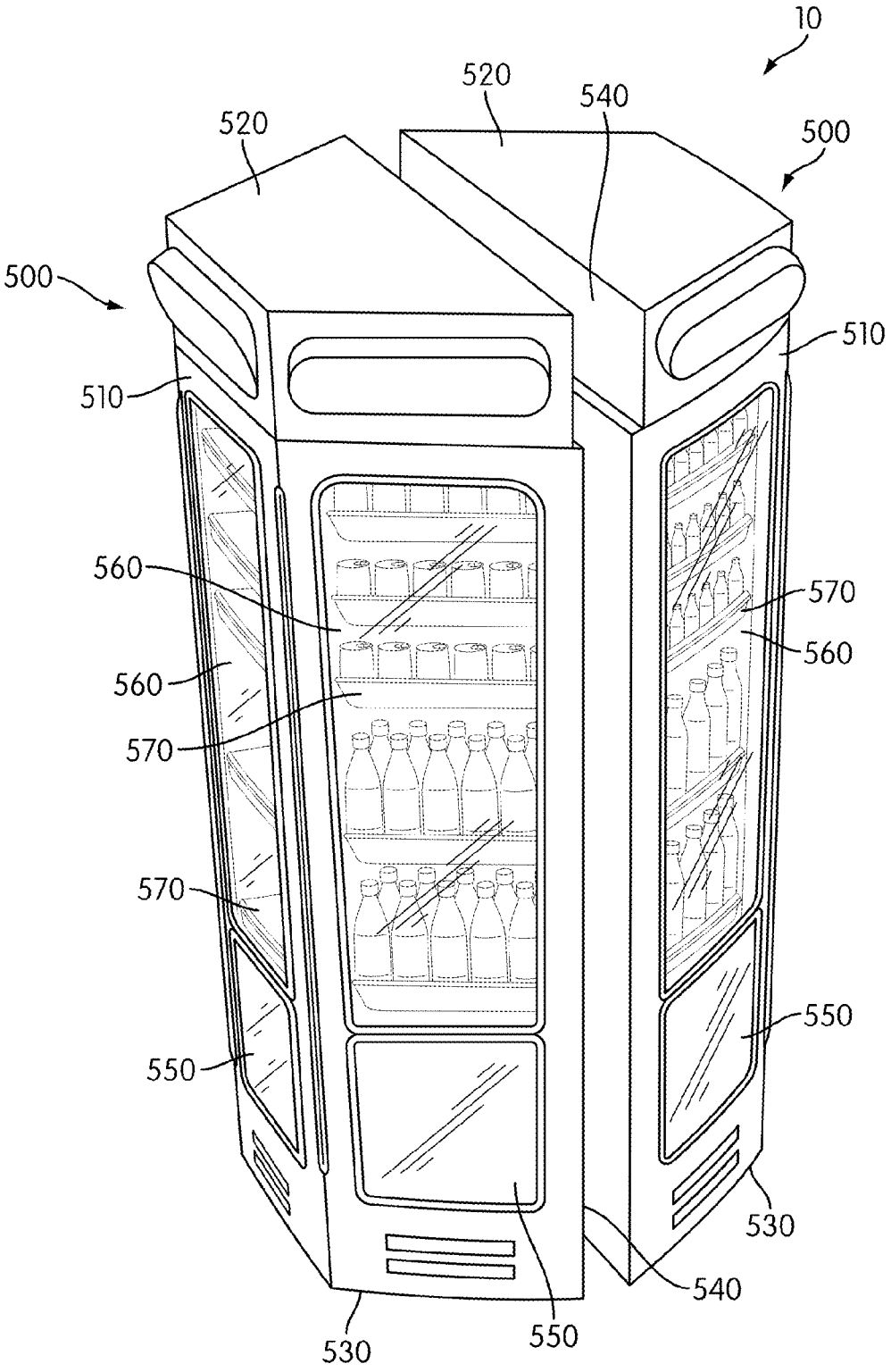
FIG. 4 is a perspective view of an alternative embodiment of the merchandise display system in accordance with the present invention.
Figure 5:
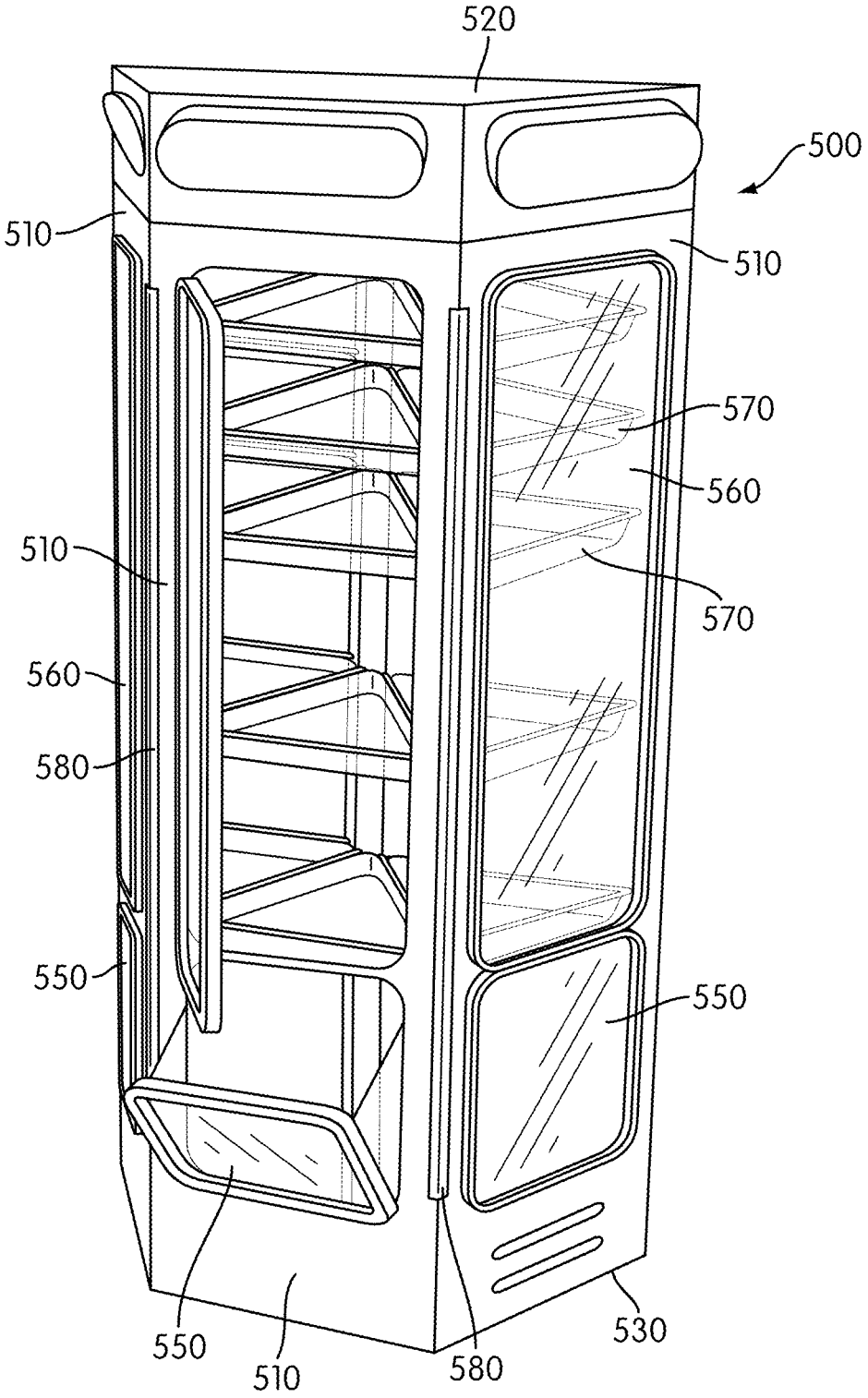
FIG. 5 is a perspective front view of the merchandise display system of FIG. 4.

In another aspect of the invention, as illustrated in FIG. 4, a plurality of display units 500 combine together to form a 360 degree merchandise display system 10. The merchandise display system 10 may include any number of display units 500. In at least one embodiment, the display system 10 includes two display units 500, positioned back to back. The display units 500 may be made of any suitable material, such as metal or plastic. In one embodiment, the display units 500 are hollow structures filled with a foam-based insulation material, which may reduce the weight of the merchandise display system 10.

The display units 500 may include a top wall 520, a bottom wall 530, a back wall 540, and a front wall 510. The front wall 510 may include a plurality of upper doors 560 and a plurality of lower doors 550. The display units 500 may contain any suitable number of upper doors 560 and lower doors 550. In at least one embodiment, each of the display units includes at least three upper doors 560 and three lower doors 550. The upper doors 560 and lower doors 550 may be made of any suitable material such as glass or plastic. In at least one embodiment, the upper doors 560 and lower doors 550 are transparent to allow visual access of the merchandise within the display unit 500. The display units 500 may be any suitable shape and size. For example, the display units may be square, rectangular, circular, semi-circular, or polygonal.

The upper doors 560 and lower doors 550 may open in any suitable manner. For example, one side of the upper doors 560 may be hingedly attached to the front wall 510 and swing outwardly to allow access to the display unit 500. In at least one embodiment, the bottom edge of the lower doors 550 is hingedly attached to the display unit 500 to allow the bottom door 550 to open outwardly from the top edge of the door 550. In at least one embodiment, the upper doors 560 and the lower doors 550 include a handle to aid in opening the upper doors 560 and lower doors 550.

The merchandise display system 10 may include a plurality of shelves 570. The plurality of shelves 570 may be made of any suitable material, such as plastic or metal. In at least one embodiment, the plurality of shelves 570 are wire structures. In at least one embodiment, the plurality of shelves 570 may be tilted or angled. The plurality of shelves 570 may be angled such that the front of the shelves 570 is lower than the back of the shelves 570. In this embodiment, gravity forces the merchandise displayed on the plurality of shelves 570 forward towards the front of the shelves 570. Alternatively, the plurality of shelves 570 may be in a horizontal position within the merchandise display system 10. The plurality of shelves may be any suitable shape. For example, the plurality of shelves 570 may be a triangular or rectangular shape.

Figure 6A:
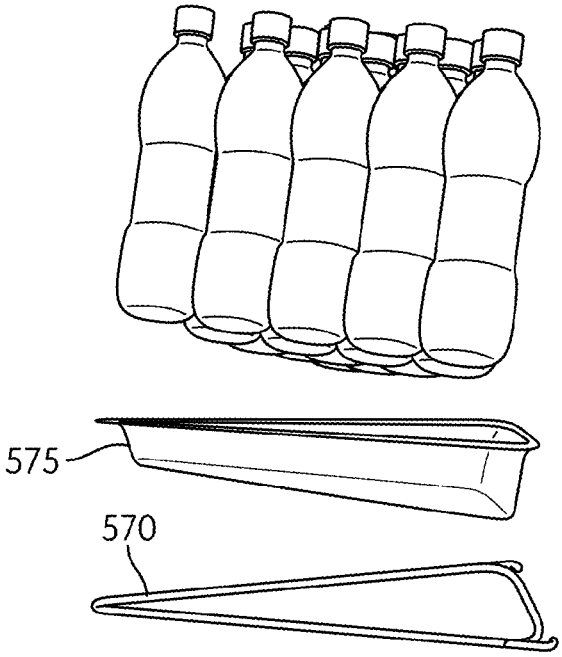
FIG. 6*a* is an exploded perspective view of the shelving system in accordance with at least one embodiment of the present invention.
Figure 6B:
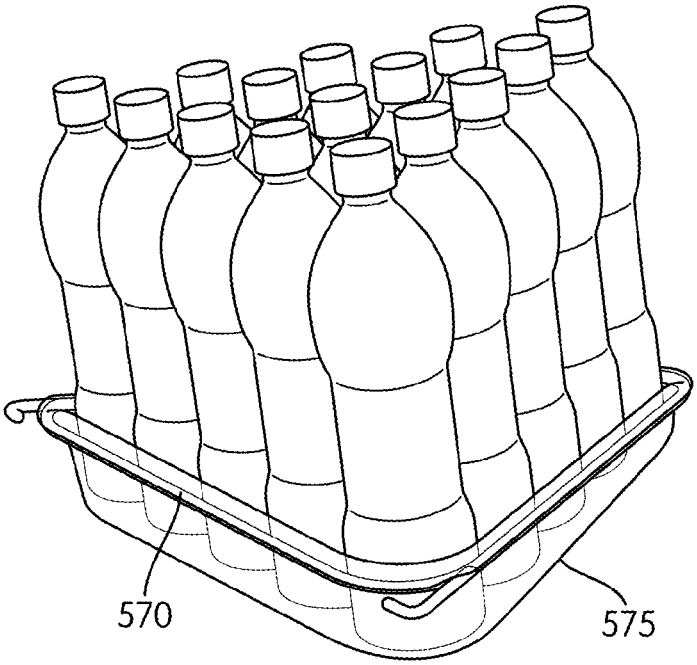
FIG. 6*b* is a perspective view of the shelving system of FIG. 6*a*.

As illustrated in FIGS. 6*a* and 6*b*, the plurality of shelves 570 may further include a basket 575 for the merchandise to be placed in. The basket 575 may rest on top of the plurality of shelves 570 or the shelves 570 may form a frame around the basket 575 and support the basket 575. In one embodiment, the plurality of shelves 570 are triangular frames that support a triangular plastic basket within the frame. In at least one embodiment, the plurality of shelves 570 are movable to different heights within the display unit 500 to accommodate merchandise of different heights. In at least one embodiment, the baskets 575 and the shelves 570 are removable from the merchandise display system 10. Any number of shelves 570 are contemplated within the scope of this invention. The number of shelves 570 may depend on many factors, such as the size of the display unit 500 and the size of the product being merchandised.

Figure 7:
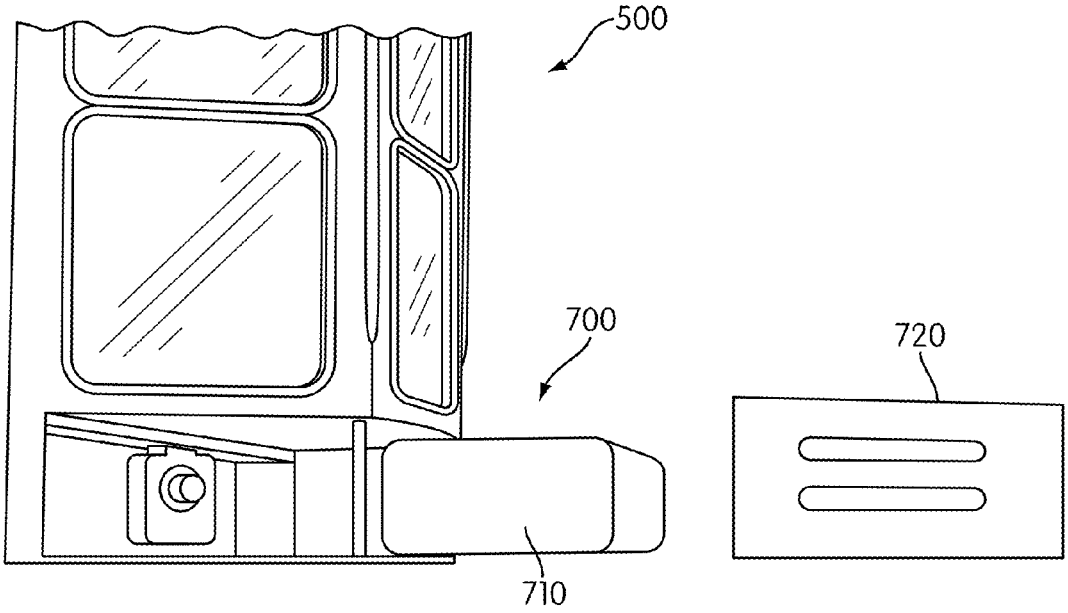
FIG. 7 is a perspective partial side view of the merchandise display system of FIG. 4.

As illustrated in FIG. 7, the merchandise display system 10 may include a base unit 700. In one embodiment, the base unit 700 is removable from the merchandise display system 10. In an alternative embodiment, the base unit 700 is attached to or integral to the merchandise display system 10. The base unit 700 includes a refrigeration unit 710 and a housing 720. The housing 720 may be made of any suitable material and may be of solid construction or may include a plurality of apertures to allow air to flow into and out of the base unit 700.

In at least one embodiment, the refrigeration unit 710 may be removable from the base unit 700. The removable refrigeration unit 710 allows for easy installation and maintenance of the refrigeration unit 710. For example, a technician may chose to replace the removable refrigeration unit 710 rather than repair it while it is connected to the merchandise display system 10.

The refrigeration unit 710 may include typical refrigeration components such as a compressor, a condenser, an evaporator, a fan, etc. The refrigeration unit 710 may use any suitable type of refrigerant to cool the merchandise display system 10. For example, R134A (tetraflouroethane), CO2 (carbon dioxide), or hydrocarbons may be used. The refrigeration components may be placed within the same enclosure in the refrigeration unit 710 and separated as necessary by insulating material. Alternatively, some of the refrigeration components may be placed in separate enclosures within the refrigeration unit 710.

The merchandise display system 10 may utilize any applicable insulation. In one embodiment, the merchandise display system 10 incorporates Aerogel insulation material. Specifically, the merchandise display system may incorporate Spaceloft insulation. The use of Spaceloft insulation may decrease the required thickness of the walls of the display system 10. Insulation may also be used in the refrigeration unit 710 to separate the condenser and evaporator within the same refrigeration unit 710.

In one embodiment, the refrigeration unit 710 may be a hybrid convection-conduction refrigeration system. In this embodiment, the refrigeration unit 710 may include a traditional vapor-compression system, which forces cool air from the refrigeration unit 710 through the display units 500 in the merchandise system 10. The merchandise displayed in the merchandise display system 10 may be cooled through a conduction process where thermal energy is passed from the shelves 570 to the merchandise to cool the merchandise. In this embodiment, heat generated during the cooling process is transferred out of the refrigeration unit 710 and display units 500.

The merchandise display system may further include a lighting system. The lighting system may include interior and exterior lighting. In at least one embodiment, the display units 500 include a plurality of exterior lights 580. The exterior lights 580 may be any suitable type of lighting, such as LEDs. The exterior lights 580 may extend vertically on the front wall 510 of the display unit 500. The exterior lights 580 may extend from the top wall 520 to the bottom wall 530 or may extend along only a portion of the front wall 510.

The display units 500 may further include a sensor system. The sensor system may be configured to sense the environment within the display unit 500. For example, the sensor system may be configured to detect the temperature or humidity in the interior of the display units 500. In at least one embodiment, the sensor system is in communication with the cooling system in the base unit 700.

The merchandise display system 10 may include logos or signs to further promote the brand or type of merchandise within the merchandise display system 10. The logos and signs may be place on any suitable surface of the merchandise display system 10. For example, a sign may be placed on the top wall 520 of the display unit 500 or logos may be attached to the upper doors 560 and lower doors 550.

Figure 8B:
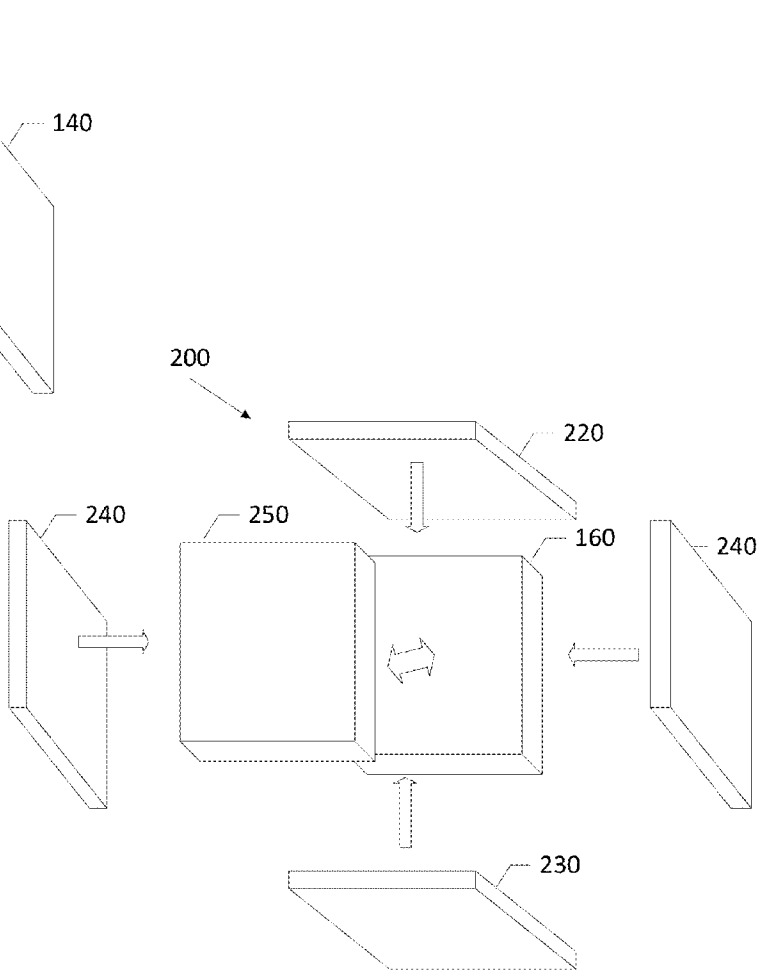
FIG. 8*b* is an exploded perspective view of the components of a base unit in accordance with at least one embodiment of the present invention.
Figure 8A:
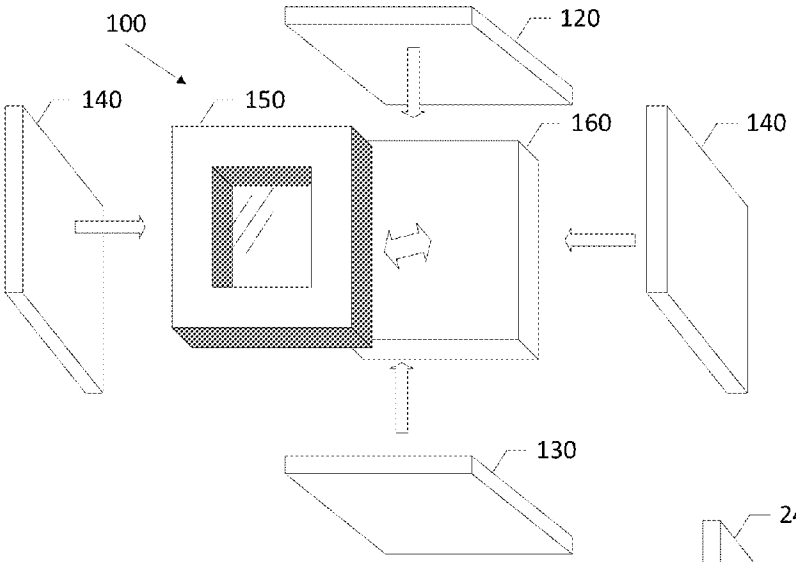
FIG. 8*a* is an exploded perspective view of the components of a display unit in accordance with at least one embodiment of the present invention.

In accordance with at least one of the embodiments described above, all or portions of the merchandise display system 10 may be shipped as component pieces and assembled at a merchandising location, such as a retail store. As illustrated in FIGS. 8*a* and 8*b*, each of the components of a display unit 100 and a base unit 200 may be separate from each other and attached together to form one or more display units 100 or base units 200. For example, as illustrated in FIG. 8*a*, two side walls 140 may attach to a top wall 120. A back wall 160 may attach to the two side walls 140 and the top wall 120. A bottom wall 130 may attach to the two side walls 140 and the back wall 160. A door 150 may attach to one or more of the bottom wall 130, two side walls 140, and the top wall 120 to form a display unit 100. In at least one embodiment, the display unit 100 includes a plurality of shelves 170 that are attached to at least the two side walls 140 and are configured to display product within the display unit 100.

The components of a base unit 200 may be assembled in a similar manner as the components for the display unit 100. As illustrated in FIG. 8*b*, two side walls 240 may attach to a top wall 220. A back wall 260 may attach to the two side walls 240 and the top wall 220. A bottom wall 230 may attach to the two side walls 240 and the back wall 260. A front wall 250 may attach to one or more of the bottom wall 230, two side walls 240, and the top wall 220 to form a base unit 200. The base unit may further include a cooling system that is removable from the base unit 200. The cooling system may include a refrigeration unit 210 and a sensor system.

The components of the display units 100 and the base units 200 may be assembled in any order and may be attached to each other in any suitable manner. For example, the one or more of the components may include tabs that cooperate with corresponding apertures on another component to attach two or more components together. The components may include projections that cooperate with a corresponding aperture on another component to attach two or more components together. Other types of attachment mechanisms, such as cam locks, locking latches, and locking brackets may be used to lock two or more components to each other.

Figure 9:
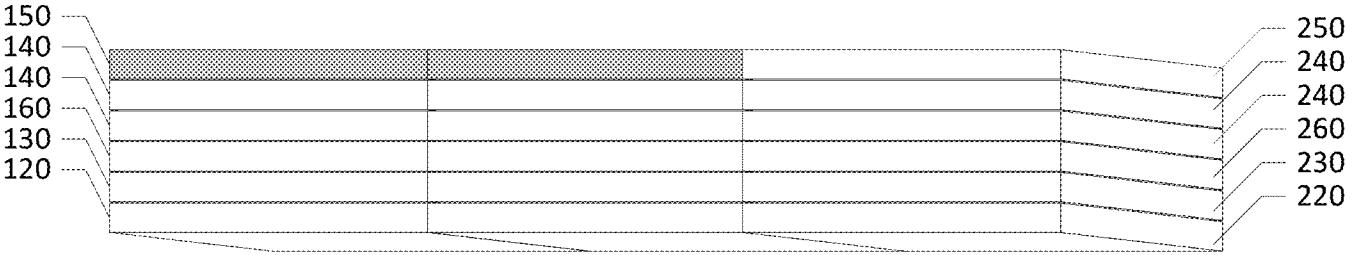
FIG. 9 is a perspective view of the components illustrated in FIGS. 8*a* and 8*b* configured to be shipped in accordance with at least one embodiment of the present invention.
Figure 10:
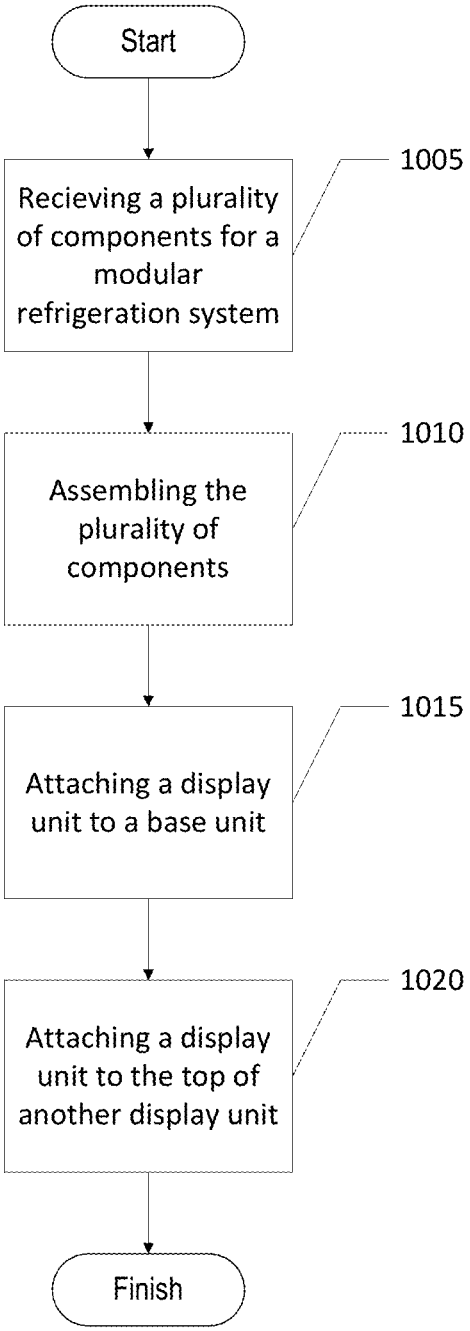
FIG. 10 illustrates an example method for shipping and assembling the components of a merchandise display system in accordance with at least one embodiment of the present invention.

In at least one embodiment, some or all of the components of a merchandise display system 10 may be shipped flat to the merchandising location. As illustrated in FIG. 9, the components of one or more base units 200 and one or more display units 100 may be stacked on top of each other or positioned next to each other and shipped in a generally flat configuration. For example, the side walls 140, door 150, top wall 120, bottom wall 130 and back wall 160 of a display unit 100 may be stacked one on top of each other and positioned in a box next to the side walls 240, front wall 250, top wall 220, bottom wall 230 and back wall 260 of a base unit 200, which may also be stacked on each other. Any number of components may be shipped flat to the merchandising location.

FIG. 9 illustrates an example method of assembling a merchandise display system 10 incorporating one or more features described above. In step 1005, one or more of the components of a merchandise display system 10 are shipped in a generally flat configuration to a merchandising location, such as a retail store, and received at the merchandising location. The components may include one or more of the following: top walls 120, 220; bottom walls 130, 230; side walls 140, 240; back walls 160, 260; doors 150, front walls 250, and a plurality of shelves 170. A cooling system, including a refrigeration unit 210 and sensor system may be shipped and received with the components or may be pre-assembled and shipped or received separately from the components. In one embodiment, the base unit 200 is pre-assembled and shipped and received separately from the components of the display units 100.

In step 1010, one or more of the components are assembled together at the merchandising location. For example, a top wall 120, bottom wall 130, two side walls 140, a back wall 160 and a door 150 are attached together to form a display unit 100. The display unit 100 may include one or more shelves 170. In step 1010, the components of a base unit 200 may also be assembled together. For example, a top wall 220, bottom wall 230, two side walls 240, a back wall 260, and a front wall 250 may be attached to form a base unit 200. The base unit may further include a cooling system that is removable from the base unit 200. The cooling system may include a refrigeration unit 210 and a sensor system. One or more display unit 100 and base unit 200 may be assembled in step 1010.

Figure 14:
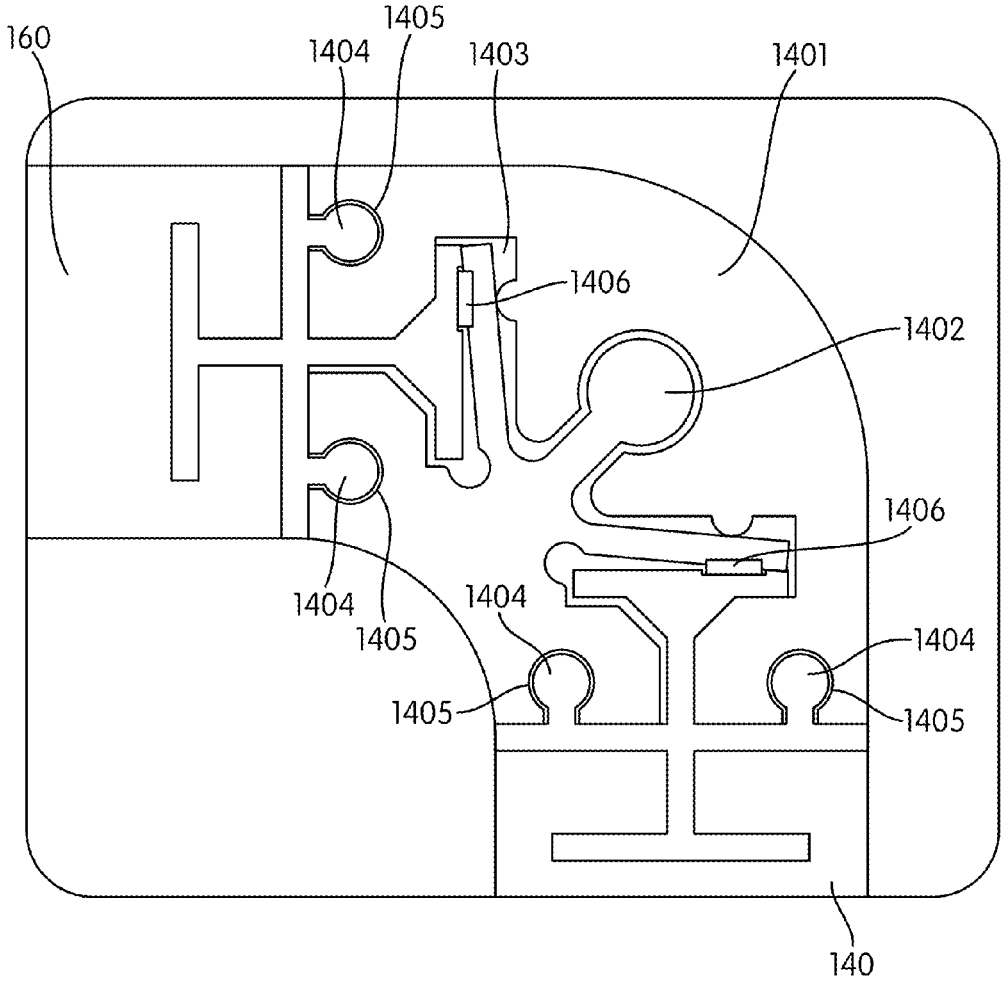
FIG. 14 illustrates the attachment of walls of a display unit or base unit in accordance with one or more aspects of the invention.

The components of the base unit 200 and display units 100 may be attached to each other in any suitable manner. In at least one embodiment, the components of the display units 100 and base unit 200 may be attached to each other via an outer post 1401 and an inner post 1402, as illustrated in FIG. 14. In this embodiment, the outer post 1401 and inner post 1402 may connect two walls of a display unit 100 or a base unit 200, such as a back wall 160 and a side wall 140 of a display unit 100. The walls may include one or more projections 1404 that engage with corresponding apertures 1405 in the outer post 1401 and inner post 1402. The outer post 1401 and inner post 1402 may be connected to each other. In at least one embodiment, the inner post 1402 has a shape with protrusions that engage corresponding apertures in the outer post 1401. In at least one embodiment, a gasket 1406 is positioned between the inner post 1402 and outer post 1401.

In step 1015, a first display unit 100 is attached to a top surface of a base unit 200. The first display unit 100 may be attached to the base unit 200 in any suitable manner. For example, as discussed above, the first display unit 100 and the base unit 200 are attached together through the use of corresponding rails. The base unit 200 may include one or more rails on the top wall 220 of the base unit 200, which engage with one or more corresponding rails on the bottom wall 130 of the first base unit 100.

In step 1020, a second display unit 100 may be attached a top surface of the top wall 120 of the first display unit 100. The display units 100 may attach to each other in a similar manner as the first display unit 100 and base unit 200. For example, each of the display units 100 may include one or more rails on each of the top walls 120, which may attach to one or more corresponding rails on the bottom walls 130 of another display unit 100. The rails may keep the display units 100 and base unit 200 aligned to give the appearance of a single modular refrigerator system. Any number of display units 100 may be attached to each other in step 1020.

As discussed above, the merchandise display system 10 may be any size. For example, the merchandise display system 10 may be a suitable size to display on a countertop or may be the size of a commercial refrigerator. The merchandise display system 10 may include one or more doors 150 that cover the front of the display units 100. The merchandise display system 10 may include one door 150 for each of the display units 100. Alternatively, one door 150 may extend vertically or horizontally to cover more than one display unit 100. In at least one embodiment, a single door 150 covers a plurality of display units 100 that are stacked on top of each other. In an alternative embodiment, a single door covers a plurality of display units 100 that are positioned adjacent each other.

Figure 11A:
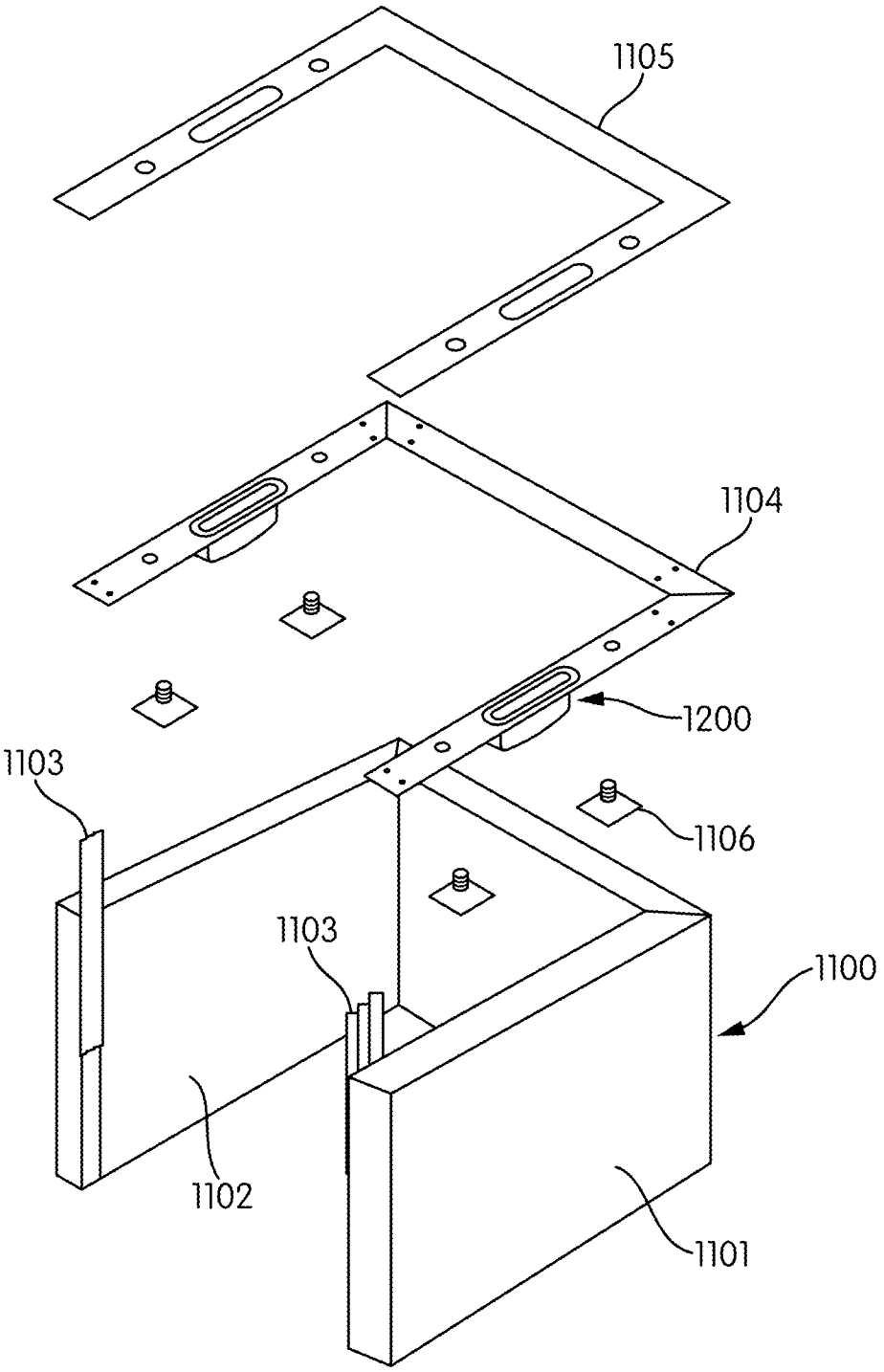
FIG. 11*a* is an exploded view of a display unit in accordance with one or more aspects of the invention.
Figure 11B:
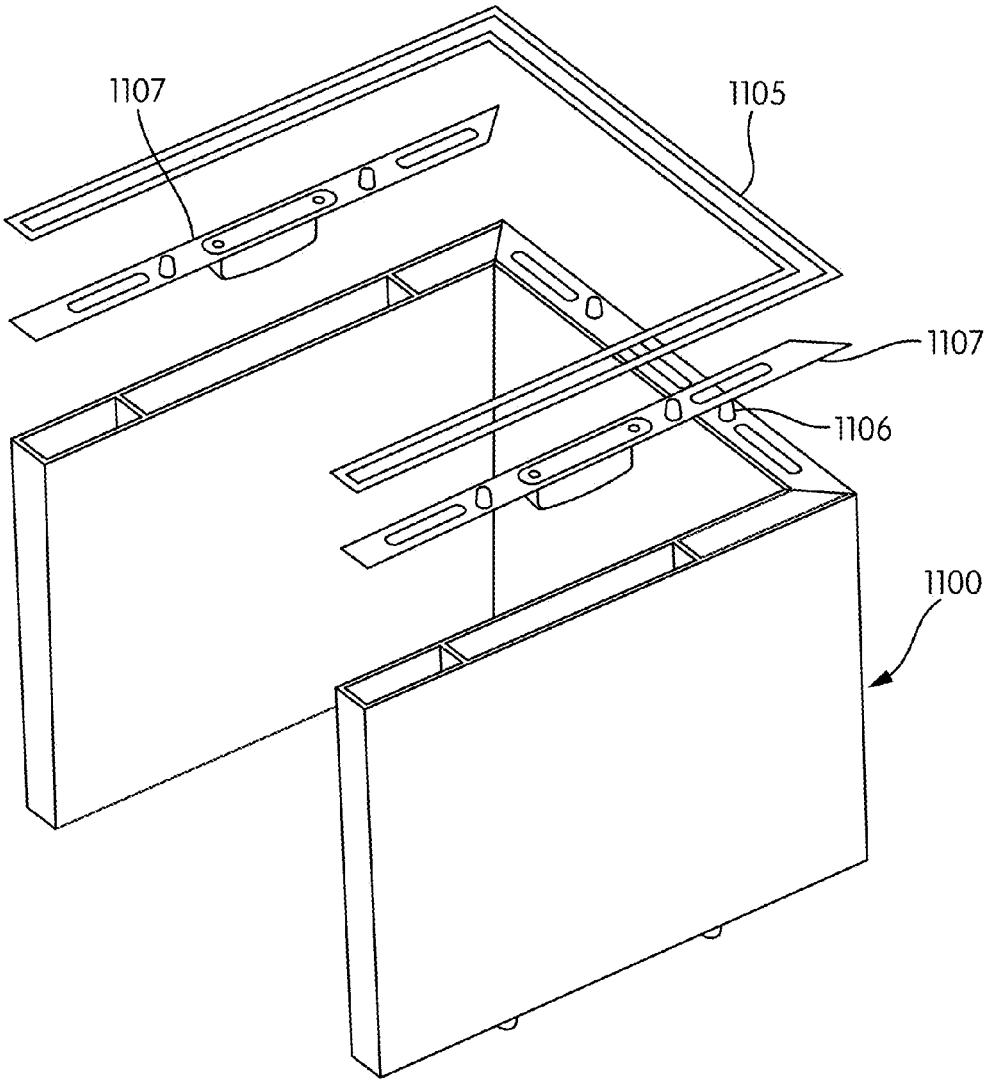
FIG. 11*b* is an exploded view of an alternative embodiment of a display unit in accordance with one or more aspects of the invention.

As illustrated in FIGS. 11*a* and 11*b*, the display units 100 may include a single C-shaped panel 1100 that forms the back wall and side walls of a display unit 100. Combining the side walls and back walls into a single C-shaped panel 1100 may lessen the number of joints in the display unit 100. Fewer joints may provide better protection against air circulation and heat leakage into the display units 100. A reduction in heat leakage may provide more efficient energy consumption for the refrigeration unit 210 and may prolong the life of a refrigeration unit 210.

In at least one embodiment, each of the display units 100 may include one C-shaped panel 1100, which forms the back wall and side walls of each of the display units 100. Each display unit 100 may also include a bottom wall 130, a top wall 120, and/or door 150 to allow access to the display unit 100. The C-shaped panel 1100 may be any size and may include any volumetric space. Additionally, the C-shaped panel 1100 may provide aesthetic appeal to the display unit 100. The C-shaped panels 1100 may be made of any suitable material, such as metal or plastic.

As discussed in embodiments above, multiple display units 100 may be stacked on top of each other. The stacked display units 100 may be attached together by any appropriate means. In at least one embodiment, the display units 100 may be attached together by cam locks, locking latches, locking brackets or any combination of attachment mechanisms. In at least one embodiment, the display units 100 may include a gasket 1105 between the C-shaped panel 1100 and the bottom wall 130 and top wall 120. Alternatively, the gasket 1105 may be placed between two C-shaped panels 1100 stacked on top of each other. The gasket 1105 may be compressed during assembly of the merchandise display system 10. The gasket 1105 may provide insulation for and may also reduce heat leakage from the display units 100. The gasket 1105 may be formed from any number of compressible materials including metal, plastic, or cork.

The display unit 100 may also include a horizontal thermal breaker 1104 and vertical thermal breakers 1103 that attach to the C-shaped panel 1100. The horizontal thermal breaker 1104 may be attached to the top and bottom edges of the C-shaped panel 1100. The horizontal thermal breaker 1104 may be any suitable shape and size. In at least one embodiment, the horizontal thermal breaker 1104 is configured to cover any openings in the top and bottom surfaces of the C-shaped panel 1100.

Figure 12:
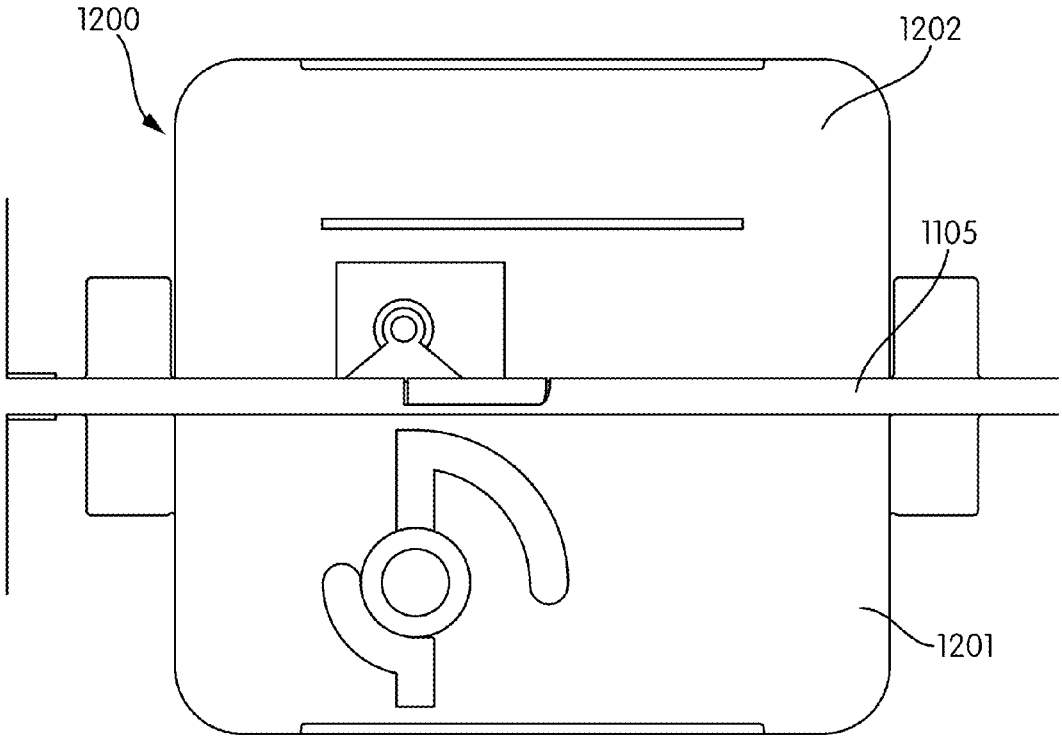
FIG. 12 illustrates a locking mechanism configured to attach the display units and/or base units.
Figure 13:
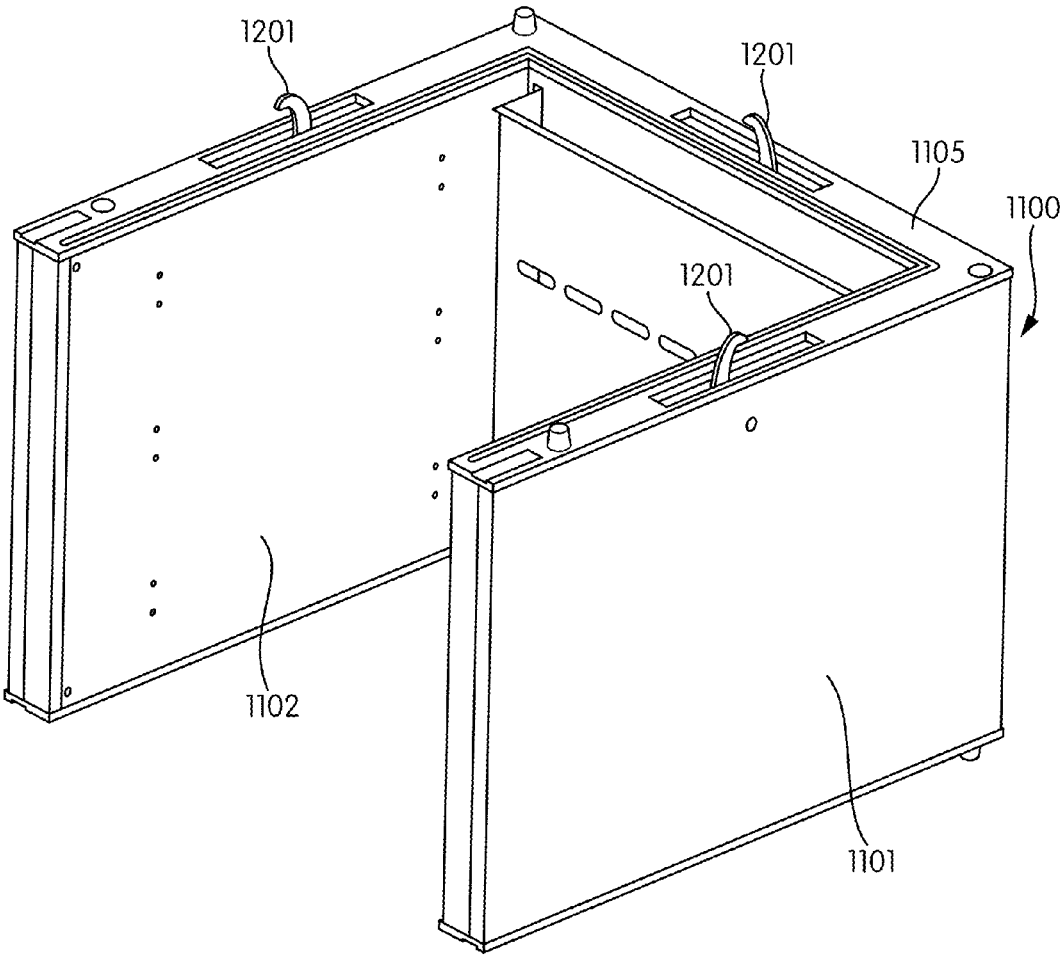
FIG. 13 illustrates the locking mechanism of FIG. 12 attached to a display unit or base unit.

The C-shaped panel 1100 may also include a gasket 1105. The gasket 1105 may engage the horizontal thermal breaker 1104. The gasket 1105 may be any suitable size and shape. In at least one embodiment, the gasket 1105 covers at least a portion of the horizontal thermal breaker 1104. Additionally, an attachment mechanism 1200 (illustrated in FIG. 12), such as a cam lock or locking latch, may be used to further compress the gasket 1105, to further prevent heat leakage and air circulation from the display unit 100. In at least one embodiment, the top portion of a first C-shaped panel 1100 may contain the base portion 1201 of a cam lock 1200, as illustrated in FIG. 13. Similarly, a second C-shaped panel 1100, configured to be stacked on the first C-shaped panel 1100, may include the top portion 1202 of a cam lock 1200 within a bottom surface of the C-shaped panel 1100. The cam lock 1200, or attachment mechanism 1200, may be placed within foam in the C-shaped panel 1100 or on a surface of the foam in the C-shaped panel 1100.

The C-shaped panel 1100 may include an inner portion 1102 positioned inside an outer portion 1101, which together form the C-shape panel 1100. The inner portion 1102 and outer portion 1101 may be made of any suitable material, such as metal or plastic. The inner portion 1102 and outer portion 1101 may provide structure and stability for the display unit 100. Upon assembly of the inner portion 1102 and the outer portion 1101, any hollow space between the inner portion 1102 and outer portion 1101 may be filled with foam to provide further insulation and support. In at least one embodiment, the foam of one display unit 100 may engage with the foam of another display unit 100 to attach the two display units 100 together. Vertical thermal breakers 1103 may be fastened to the inner portion 1102 and outer portion 1103 in the approximate area where the door 150 attaches to the C-shaped panel 1100. The thermal breakers 1103 and 1104 may be made of any suitable material, such as rubber or plastic. The thermal breakers 1103 and 1104 may help prevent air circulation between portions of the display units 100.

In at least one embodiment, locators 1106 may positioned on the top and bottom surfaces of the C-shaped panel 1100. Alternatively the locators 1106 may be placed within the horizontal thermal breakers 1104. In at least one embodiment, the locators 1106 aid in the engagement of two C-shaped panels 1100. The locators 1106 may be placed in one C-shaped panel 1100 and may be positioned to protrude into grooves or holes in a second C-shaped panel 1100. The locators 1106 may include stanchions or any other suitable type of supporting mechanism.

In at least one embodiment, as illustrated in FIG. 11*b*, a C-shaped panel 1100 may be constructed as a unitary piece. The unitary C-shaped panel 1100 may be constructed in any suitable manner, such as through plastic extrusion. The unitary C-shaped panel 1100 may include one or more top covers 1107, which cover the openings of the C-shaped panel 1100. In at least one embodiment, the unitary C-shaped panel 1100 may include three top covers 1107, one top cover 1107 on the top surface of each side of the C-shaped panel 1100 (e.g., the top and two sides). In at least one embodiment, the unitary C-shaped panel 1100 includes thermal breakers, similar to the thermal breakers illustrated in FIG. 11*a*. The unitary C-shaped panel 1100 may also include bottom panels on each side of the bottom surface of the C-shaped panel 1100. A gasket 1105 may be placed on top of the top covers 1107. The gasket 1105 may be any suitable size or shape. In at least one embodiment, the gasket 1105 is configured to cover at least a portion of the top covers 1107. In at least one embodiment, a top wall 120 may be placed on top of the unitary C-shaped panel 1100. Alternatively, a second C-shaped panel 1100 may be placed on a first C-shaped panel 1100.

As described above, the C-shaped panels 1100 may be attached to each other by locking mechanisms 1200, which may be a cam locks, locking latches, locking brackets or any combination of attachment mechanisms. In at least one embodiment, a C-shaped panel 1100 may be attached to a base unit by one or more locking mechanisms 1200. In one embodiment, as illustrated in FIG. 12, a cam lock 1200 for attaching two C-shaped panels 1100 is shown. The top portion 1202 and the bottom portion 1201 of the cam lock 1200 may assist in compressing the gasket 1105 between the two C-shaped panels 1100. Additionally, locking mechanisms, such as cam locks 1200 may be used to attach adjacent display units 100, which are configured horizontally, to each other.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims. Additionally, one of ordinary skill in the art will appreciate that the steps illustrated in the illustrative figures may be performed in other than the recited order, and that one or more steps illustrated may be optional in accordance with aspects of the disclosure.

What is claimed is:

1. A merchandise display system comprising:

a display unit including a door and a C-shaped panel that forms a back wall, a first side wall, and a second side wall;

a first C-shaped horizontal thermal breaker attached to a top surface of the back wall, a top surface of the first side wall, and a top surface of the second side wall;

a second C-shaped horizontal thermal breaker attached to a bottom surface of the back wall, a bottom surface of the first side wall, and a bottom surface of the second side wall; and a first vertically extending thermal breaker attached to an interior surface of the first side wall and extending from the bottom surface of the first side wall to the top surface of the first side wall;

a second vertically extending thermal breaker attached to an interior surface of the second side wall and extending from the bottom surface of the second side wall to the top surface of the second side wall; and a removable base unit having a top and a bottom, the removable base unit including a cooling system to cool the display unit and a sensor system to sense environmental parameters within the display unit;

wherein the display unit is configured to engage the top of the base unit.

2. The merchandise display system of claim 1, wherein the C-shaped panel includes an inner portion and an outer portion.

3. The merchandise display system of claim 2, wherein the inner portion and outer portion are made of metal.

4. The merchandise display system of claim 1, wherein the C-shaped panel is of unitary construction.

5. The merchandise display system of claim 4, further comprising:

a cover attached to the top surface of the C-shaped panel.

6. The merchandise display system of claim 1, wherein the C-shaped panel is made of plastic.

7. The merchandise display system of claim 1, further comprising a gasket positioned between the second C-shaped horizontal thermal breaker and the top of the base unit.

8. The merchandise display system of claim 7, wherein the gasket is compressed between the C-shaped panel and the base unit.

9. A merchandise display system comprising:

a first display unit including a door and a C-shaped panel that forms a back wall, a first side wall, and a second side wall, each of the back wall, first side wall, and second side wall having an interior surface and an exterior surface;

a second display unit including a door and a C-shaped panel that forms a back wall, a first side wall, and a second side wall, each of the back wall, first side wall, and second side wall having an interior surface and an exterior surface;

a locking mechanism to engage the first display unit with a top of the second display unit, the locking mechanism having:

a top portion positioned between the interior surface and the exterior surface of one of the first side wall and the second side wall, the top portion extending to a depth within the one of the first side wall and the second side wall from a bottom surface of the first display unit C-shaped panel, and-a bottom surface between an interior surface and an exterior surface of the first display unit and a bottom portion positioned between the interior surface and the exterior surface of one of the first side wall and the second side wall, the top portion extending to a depth within the one of the first side wall and the second side wall from a top surface of the second display unit, wherein the top portion of the lock and the bottom portion of the lock engage to fasten the first display unit to the second display unit;

a gasket compressed between the first display unit and the second display unit when the locking mechanism engages the first display unit and the second display unit;

at least two horizontal thermal breakers, each configured to attach to only one of the side walls on one of a top surface and a bottom surface of the second display unit;

a pair of vertically extending thermal breakers, each configured to attach to one of the side walls proximate a front of the second display unit; and a removable base unit having a top and a bottom, the removable base unit including a cooling system to cool the first display unit and the second display unit and a sensor system to sense environmental parameters within the first display unit and the second display unit, wherein the second display unit is configured to engage the top of the base unit.

10. The merchandise display system of claim 9, wherein the at least one locking mechanism is a cam lock.

11. The merchandise display system of claim 9, wherein the gasket is compressed between the first display unit and the second display unit when the locking mechanism engages the first display unit to the second display unit.

12. The merchandise display system of claim 9, wherein the interior surface and the exterior surface are metal plates.

13. The merchandise display system of claim 9, wherein the C-shaped panel is of unitary construction.

14. A merchandise display system comprising:

a first display unit including a C-shaped panel that forms a back wall, a first side wall, and a second side wall, the first display unit having an interior area enclosed by the C-shaped panel;

a second display unit including a C-shaped panel that forms a back wall, a first side wall, and a second wall, the first display unit having an interior area enclosed by the C-shaped panel;

a door extending across the first display unit and the second display unit;

a compressible gasket;

a locking mechanism having a top portion positioned within a bottom surface between an interior surface and an exterior surface of the first display unit and a bottom portion positioned within a top surface between an interior surface and an exterior surface of the second display unit, wherein the top portion of the lock and the bottom portion of the lock engage to fasten the first display unit to the second display unit such that the interior area of the first display unit is fluidly connected to the interior area of the second display unit; and a first C-shaped horizontal thermal breaker attached to a top surface of the first display unit C-panel;

a second C-shaped horizontal thermal breaker attached to a bottom surface of the first display unit C-panel; and a third C-shaped horizontal thermal breaker attached to a bottom surface of the second display unit C-panel;

a first vertically extending thermal breaker attached to an interior surface of the first display unit first side wall;

a second vertically extending thermal breaker attached to an interior surface of the first display unit second side wall, wherein the first display unit is configured to engage a top of the second display unit a removable base unit having a top and a bottom, the removable base unit including a cooling system to cool the first display unit and the second display unit and a sensor system to sense environmental parameters within the first display unit and the second display unit, wherein the second display unit engages the top of the base unit, wherein the gasket is positioned between the first display unit and the second display unit, wherein a portion of the locking mechanism is attached to the first display unit and a second portion of the locking mechanism is attached to the second display unit, and wherein the gasket is compressed between the first display unit and the second display unit when the locking mechanism is in the locked position.

15. The merchandise display system of claim 14, wherein the locking mechanism is a cam lock.

16. The merchandise display system of claim 14, further comprising:

a plurality of locking mechanisms.

* * * * *